US007588409B2

(12) United States Patent
Foroni

(10) Patent No.: US 7,588,409 B2
(45) Date of Patent: Sep. 15, 2009

(54) MODULAR ASSEMBLY FOR MANUFACTURING STRUCTURES FOR SUPPORT AND POWERED TRANSLATION OF FORKS IN LIFT TRUCKS

(75) Inventor: Pietro Foroni, Casalpusterlengo Lo (IT)

(73) Assignee: Bolzoni S.p.A. (IT)

( * ) Notice: Subject to any disclaimer, the term of this patent is extended or adjusted under 35 U.S.C. 154(b) by 375 days.

(21) Appl. No.: 11/065,411

(22) Filed: Feb. 24, 2005

(65) Prior Publication Data

US 2005/0186059 A1 Aug. 25, 2005

(30) Foreign Application Priority Data

Feb. 25, 2004 (IT) ..... MI2004A0325

(51) Int. Cl.
*B66F 9/14* (2006.01)

(52) U.S. Cl. ..... 414/667; 414/671

(58) Field of Classification Search ..... 414/664, 414/667, 668, 671

See application file for complete search history.

(56) References Cited

U.S. PATENT DOCUMENTS

| | | | | | |
|---|---|---|---|---|---|
| 2,820,562 | A | * | 1/1958 | Schenkelberger | 414/671 |
| 3,353,698 | A | * | 11/1967 | Link | 414/667 |
| 3,819,078 | A | * | 6/1974 | Walsh | 414/671 |
| 4,406,575 | A | * | 9/1983 | Gaibler | 414/667 |
| 4,607,997 | A | * | 8/1986 | Asano | 414/667 |
| 4,961,681 | A | * | 10/1990 | Threatt | 414/607 |
| 5,052,881 | A | * | 10/1991 | Keffeler et al. | 414/634 |
| 5,147,171 | A | * | 9/1992 | Murray et al. | 414/671 |
| 5,190,436 | A | * | 3/1993 | Sorlie | 414/667 |
| 5,217,343 | A | * | 6/1993 | Bostad et al. | 414/667 |
| 5,336,039 | A | * | 8/1994 | House | 414/621 |
| 5,707,201 | A | * | 1/1998 | Hamlik | 414/668 |
| 5,807,060 | A | * | 9/1998 | Hamlik | 414/668 |
| 5,913,654 | A | * | 6/1999 | Kaup | 414/667 |
| 6,279,686 | B1 | * | 8/2001 | Kaup | 187/285 |
| 6,390,763 | B1 | * | 5/2002 | Prentice | 414/667 |

FOREIGN PATENT DOCUMENTS

| | | | | |
|---|---|---|---|---|
| GB | 2099787 | A | * | 12/1982 |
| JP | 52033245 | A | * | 3/1977 |
| JP | 01181699 | A | * | 7/1989 |
| JP | 05221600 | A | * | 8/1993 |
| JP | 06199497 | A | * | 7/1994 |
| JP | 06345398 | A | * | 12/1994 |

* cited by examiner

*Primary Examiner*—James Keenan
(74) *Attorney, Agent, or Firm*—Shlesinger & Fitzsimmons

(57) ABSTRACT

A modular assembly for manufacturing structures for lateral translation and/or support of forks in lift trucks, which is formed of a first frame designed to be fastened to the lifting members of a lift truck and of a second movable frame to be mounted on the first frame to slide thereon through of rollers and/or runners and laterally moved, upon command, on the first frame by means of an actuator. The second frame is provided with hooking means for fastening of forks thereto, so that said forks project therefrom at the front. The first frame too is provided with hooking means of its own for direct fastening of forks, as an alternative to mounting of the second frame thereon, the second frame being made to be removable from the first frame. Runner or roller elements can be mounted in different ways to obtain the different sliding arrangements between the frames.

19 Claims, 6 Drawing Sheets

MODULAR ASSEMBLY FOR MANUFACTURING STRUCTURES FOR SUPPORT AND POWERED TRANSLATION OF FORKS IN LIFT TRUCKS

BACKGROUND OF THE INVENTION

1. Field of the Invention

The present invention relates to a modular assembly for support and powered lateral translation of forks in lift trucks.

2. State of the Prior Art

About 75% of lift trucks are equipped with lateral translation devices for the forks that are generally formed of two slidably coupled frames, one designed for hooking on the truck and the other for support of the forks. Also provided between the frames is a hydraulic or electric powering system for relative side translation of one frame with respect to the other.

These devices are substantially divided into two big categories: translators designed to be hooked to the normal fork-carrying plate of the truck and integral translators, mounted in place of the fork-carrying plate.

In the first case there is the advantage of utilizing the fork-carrying plate with which all trucks are provided since the origin. On the other hand, there is the disadvantage that mounting on the fork-carrying plate involves forward displacement of the nominal center of gravity of the load of about 5.5% (relative to the front wheel axis of the truck), due to the thickness of the pair of frames, which will bring about a reduction of same amount in the rated capacity load of the truck.

The integral translators mounted in place of the fork-carrying plate eliminate the thickness of the plate itself (that generally can be compared to the thickness of one of the two frames). In this manner forward displacement of the center of gravity of the load is reduced to about 2.5%, therefore with a higher residual capacity load of the lift truck as compared with the hooked model.

Since the integral translator represents an improvement relative to the hooked translator, it encounters greater favor on the market.

Application of the integral translator however involves some disadvantages for truck manufacturers, among which there is first of all a severer programming of the truck production, since the trucks on which the integral translator is to be mounted must be defined in advance because they need to be devoid of the fork-carrying plate. Experience has proved that often with lift truck retailers the truck version required by the customer very often is not ready on the market, so that very expensive dismantling and replacement operations are necessary.

This fact is much more frequent when the truck manufacturer is in another country or continent, the truck models are more standardized and the amounts of trucks present with the retailer are higher.

The problem is made worse by the fact that generally different versions are provided for each integral translator (in order to optimize performance, based on the type of truck, the work environment and use), said translators differentiating from each other for the type of slide guides (guides provided with runners, rollers or mixed guides) and for the type of power supply (hydraulic or electric power supply). Generally there is a version provided with upper and lower runners (made of a high-strength special resin with self-lubricating additives) and with a hydraulic jack, of a more reduced cost and adapted for indoor uses and clean outdoor environments; a version provided with upper runners and lower rollers also having a hydraulic jack, recommended for damp, acid and dusty environments where the lower runners would need a more frequent servicing; and a version provided with upper and lower rollers and with an electric actuator, designed for electric trucks, because it enables a very important energy saving.

It is a general aim of the present invention to obviate the above mentioned drawbacks by providing a modular assembly enabling a selection among the different possibilities so that a truck will be provided with the desired translation system in an easy and inexpensive manner and with a minimum loss of capacity load.

SUMMARY OF THE INVENTION

In view of this aim, in accordance with the invention, a modular assembly for manufacturing structures for lateral translation and/or support of forks in lift trucks has been devised, which is formed of a first frame, designed to be fastened to the lifting members of a lift truck, and of a second movable frame that can be mounted on the first frame to slide thereon by means of rollers and/or runners and is laterally moved, upon command, on the first frame by means of an actuator, the second frame being provided with hooking means for fastening of forks thereto so that said forks project therefrom at the front and the first frame too being provided with hooking means of its own for direct fastening of forks, as an alternative to mounting of the second frame thereon, the second frame being made to be removable from the first frame. In particular, the second frame can be mounted on the first frame for sliding thereon by means of shaped guides disposed between an upper horizontal bar and a lower horizontal bar and by means of rollers and/or runners.

BRIEF DESCRIPTION OF THE DRAWINGS

For better explaining the innovative principles of the present invention and the advantages it offers over the known art, a possible embodiment applying said principles will be described hereinafter, by way of example, with the aid of the accompanying drawings. In the drawings.

DETAILED DESCRIPTION OF THE INVENTION

Figure 1:
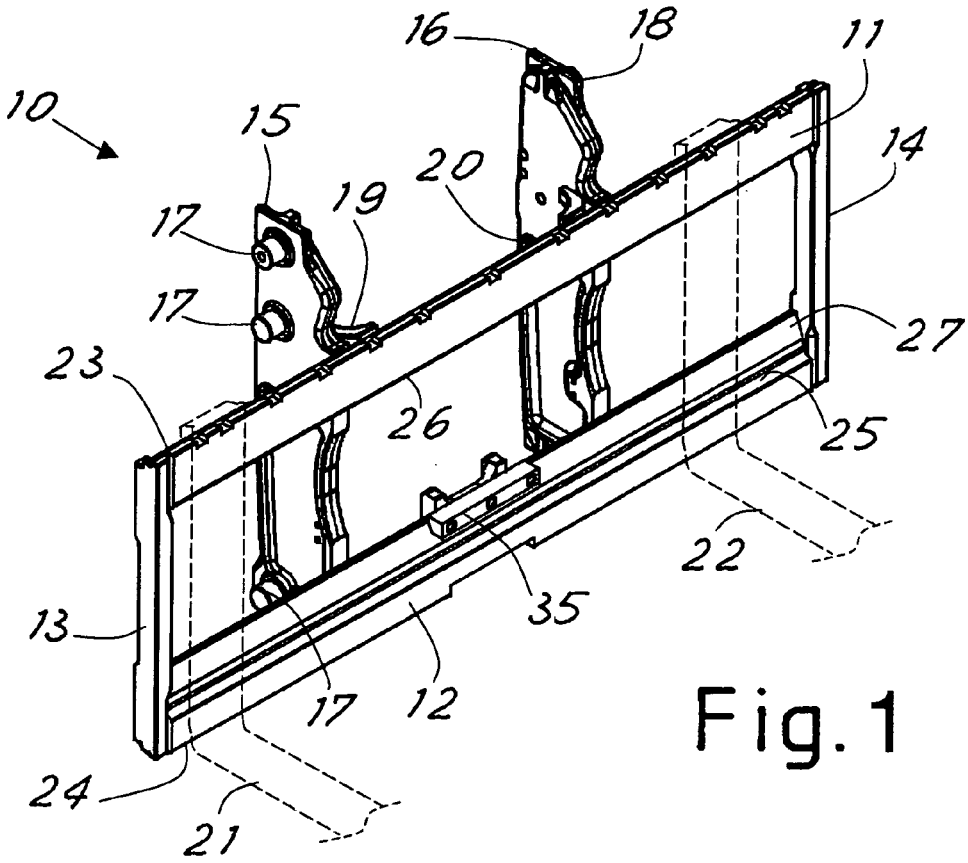
FIG. 1 is a diagrammatic perspective front view of a base element of the translator in accordance with the invention.
Figure 2:
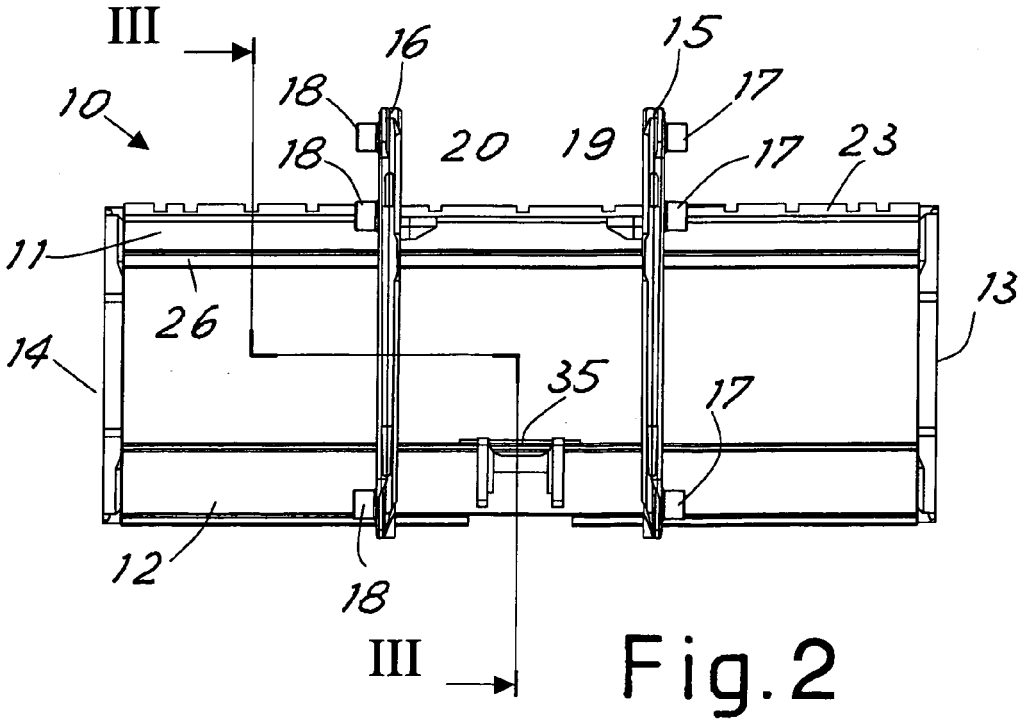
FIG. 2 is an elevation rear view of the element in FIG. 1.

With reference to the drawings, diagrammatically shown in FIG. 1 is a first frame, generally denoted at 10, for manufacturing the modular assembly in accordance with the invention. This frame 10 is designed to be fastened to the lifting members of a lift truck (not shown, as it can be easily envisaged by a person skilled in the art). In particular, the frame shown comprises an upper crosspiece 11 and a lower crosspiece 12, interconnected at the ends by means of two side uprights 13 and 14. As clearly shown also in the rear view in FIG. 2, also provided at an intermediate position are two vertical plates 15, 16 projecting from the frame at the rear and provided with known elements 17, 18 for fastening of the frame to the lifting members of the truck by means of any known system for a fork-carrying plate. Suitable angular reinforcements 19, 20 can be provided between the vertical plates and the crosspieces.

Figure 3:
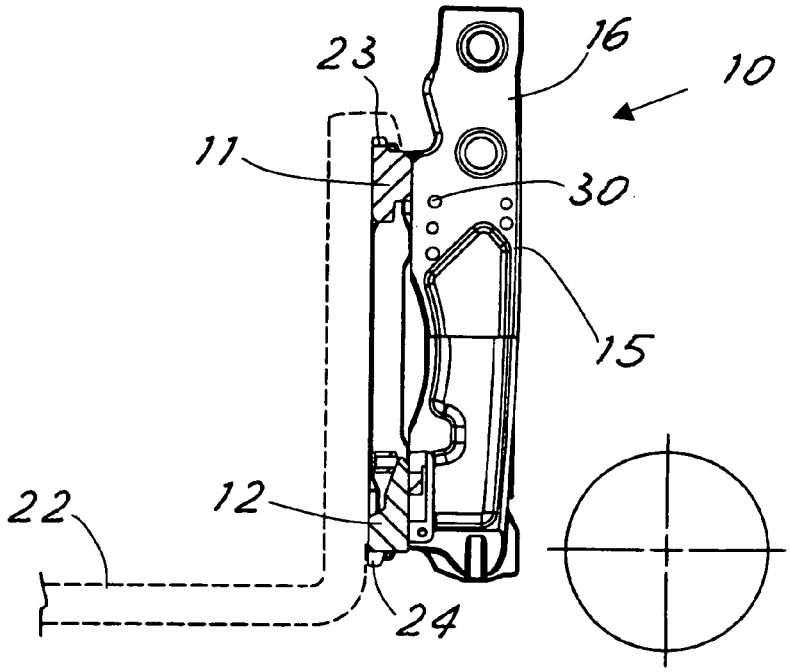
FIG. 3 is a sectional view of the base element taken along line III-III in FIG. 2.

As shown in chain line in FIG. 1 and, in greater detail in FIG. 3, the upper crosspiece of frame 10, on the upper edge comprises hooking means having the shape of a step 23 for hanging up two normal forks 21, 22, so that these forks may project at the front of the truck, parallel to each other. According to a known technique, a lower tooth 24 can be used to lock the forks at the bottom and prevent accidental removal of the latter.

In this way frame 10 can be used in place of a normal fork-carrying plate. Advantageously, the frame can be sized following standard measures for this type of plates, in accordance with UNI ISO 2328 specifications, for example. The first frame also comprises suitable horizontal slide surfaces for a second frame, as specified in the following. Advantageously, the slide surfaces comprise a horizontal track surface 25 that is forward inclined and disposed in the vicinity of a lower side of the first frame, a horizontal track 26 facing downwards and disposed close to the upper side of the frame and a second horizontal track surface 27, still in a position close to the lower side of the frame.

As viewed from FIGS. 4 to 11, the second frame, generally denoted at 28, has the same structure and sizes as frame 10. This second frame can be mounted on the first frame for sliding thereon by means of rollers and/or runners and is laterally moved, upon command, on the first frame by means of a suitable actuator.

The second frame 28 too is provided with hooking means, in the form of an upper step 29, for fastening of the forks thereto, so that said forks project from the frame itself at the front.

As clarified in the following, the surface 25 of the first frame is designed for support of corresponding runners possibly to be mounted or already mounted on the second frame; track 26 is intended for slidable fitting of further corresponding runners possibly to be mounted or already mounted on the second frame; surface 27 supports a pair of rollers possibly to be mounted or already mounted on the second frame. All that is obtained following different arrangements of the second frame 25.

Figure 4:
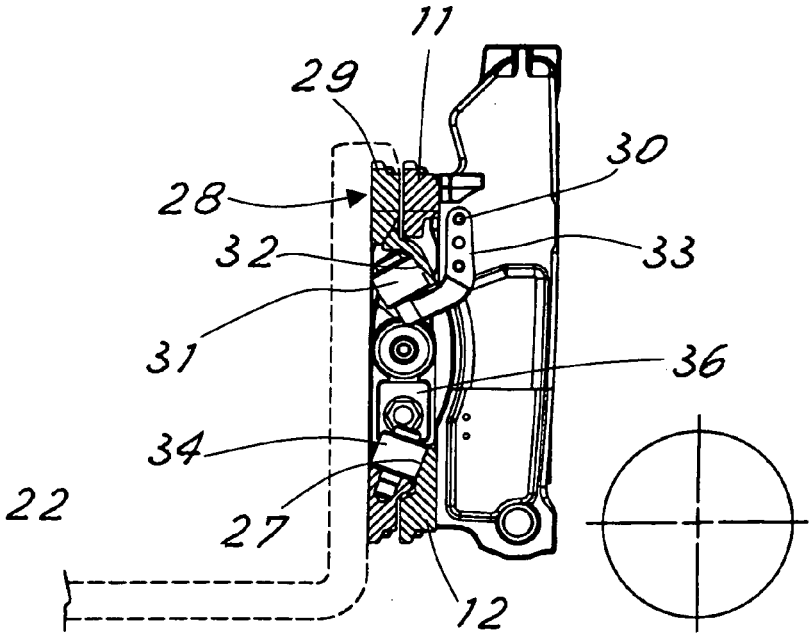
FIG. 4 is a sectional view, taken along line IV-IV in FIG. 5, of an assembly formed of the base element of FIG. 1 coupled with a first powered translating element and with roller-type slide guides.

In more detail, shown in FIG. 4 is a first arrangement of frames 10 and 25 in which the second frame slides on the first frame by means of two series of suitable rollers. Of these series of rollers, one is disposed at the top and one at the bottom of the frames. To this aim, provided on the first frame and in particular on each vertical plate are holes 30 for fastening of rollers 31 having an inclined axis and forming a slidable rest for a suitable track surface 32 present on the second frame which is horizontal and inclined downwards. For a support in the proper position, each roller is provided with an L-shaped support arm 33. These arms with the respective roller can be easily mounted or dismantled depending on requirements. The second frame 28 comprises a pair of sliding rollers 34, mounted with an inclined axis on the lower crosspiece of the second frame. These rollers 34 rest on the correspondingly-inclined horizontal track surface 27 of the first frame.

As shown in FIG. 4, the upper rollers 31 enable slidable hanging of the second frame on the first, whereas the lower rollers are used as a reaction against the load weight on the forks, tending to push the lower portion of the second frame against the first frame.

For mounting of the actuator, the first frame has a mounting plate 35 disposed at a centered position relative to side edges thereof and close to the lower edge. In particular, said plate is advantageously mounted over the lower crosspiece.

Figure 5:
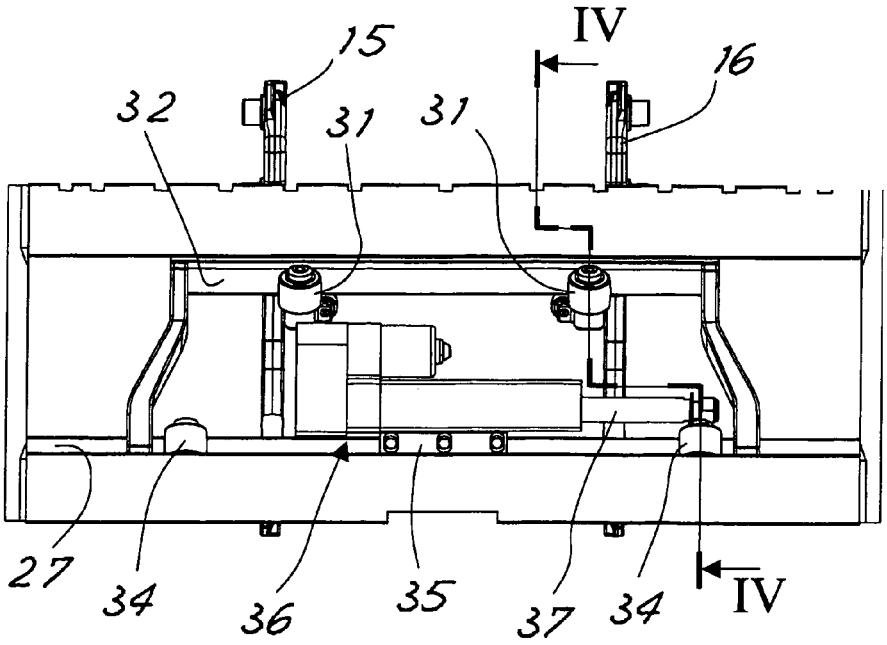
FIG. 5 is an elevation front view of the assembly in FIG. 4.
Figure 6:
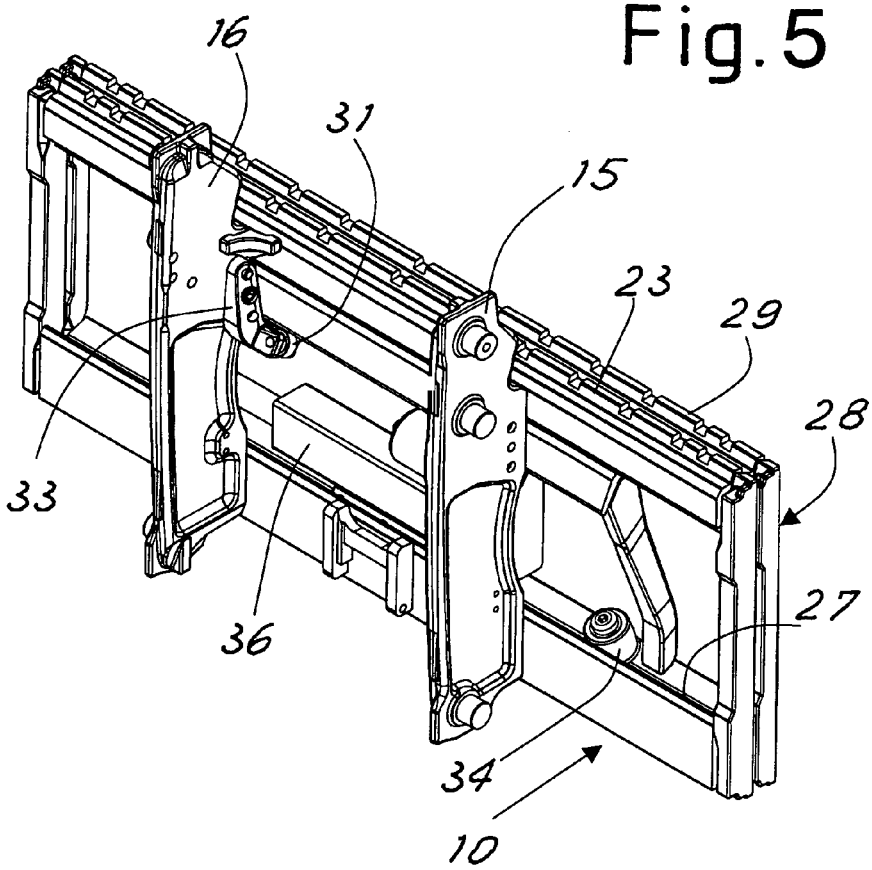
FIG. 6 is a rear perspective view of the assembly in FIG. 4.

In the embodiment in FIGS. 4 to 6, actuator 36 is of a known linear type with an electric motor and has a driving rod 37 with an end fastened to the second frame. Due to the movement on rollers, the electric power for translation can be maintained relatively low. This solution is advantageous above all in the case of electric trucks.

Figure 7:
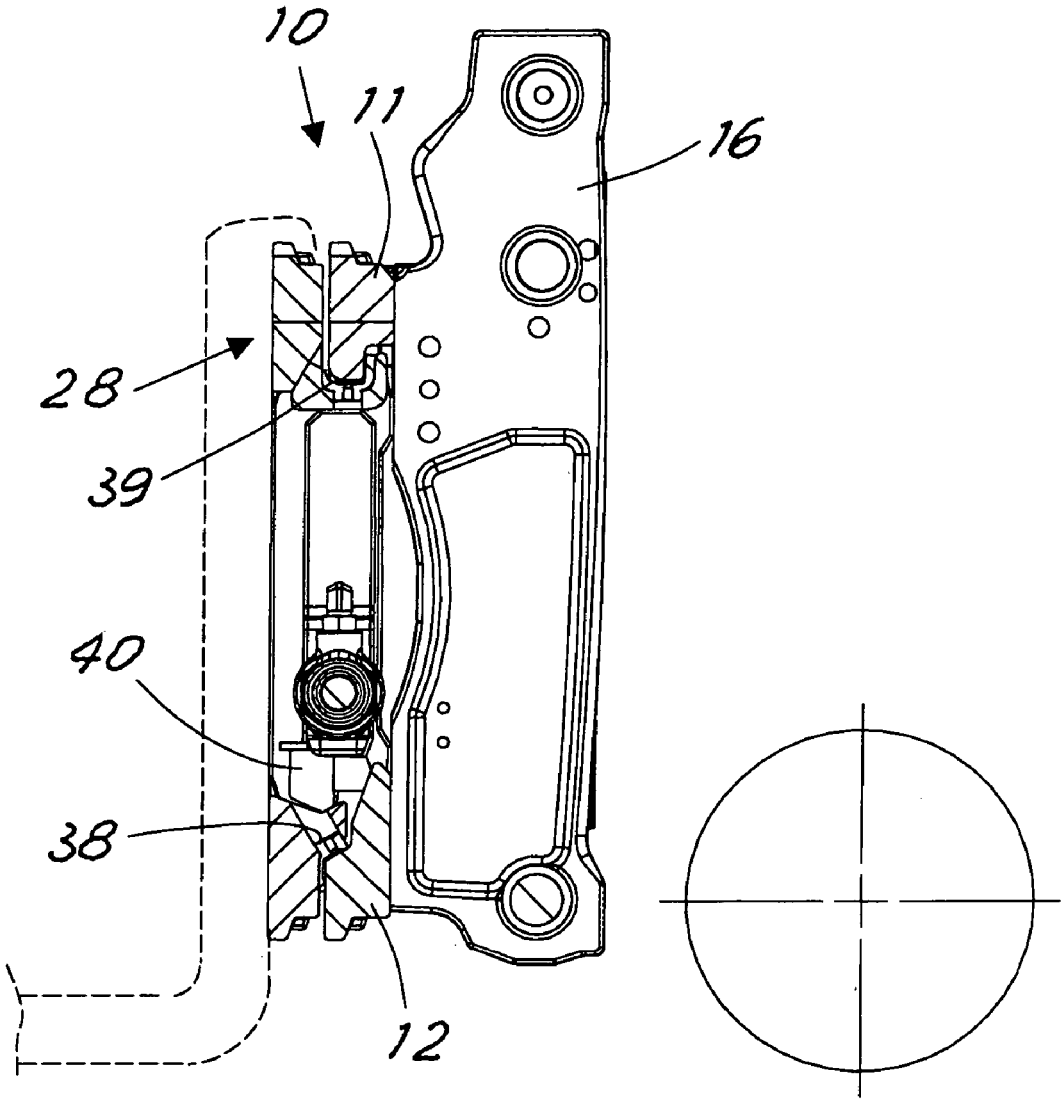
FIG. 7 is a sectional view, taken along line VII-VII in FIG. 8, of an assembly formed of the base element of FIG. 1 coupled with a second powered translating element and with runner-type slide guides.
Figure 8:
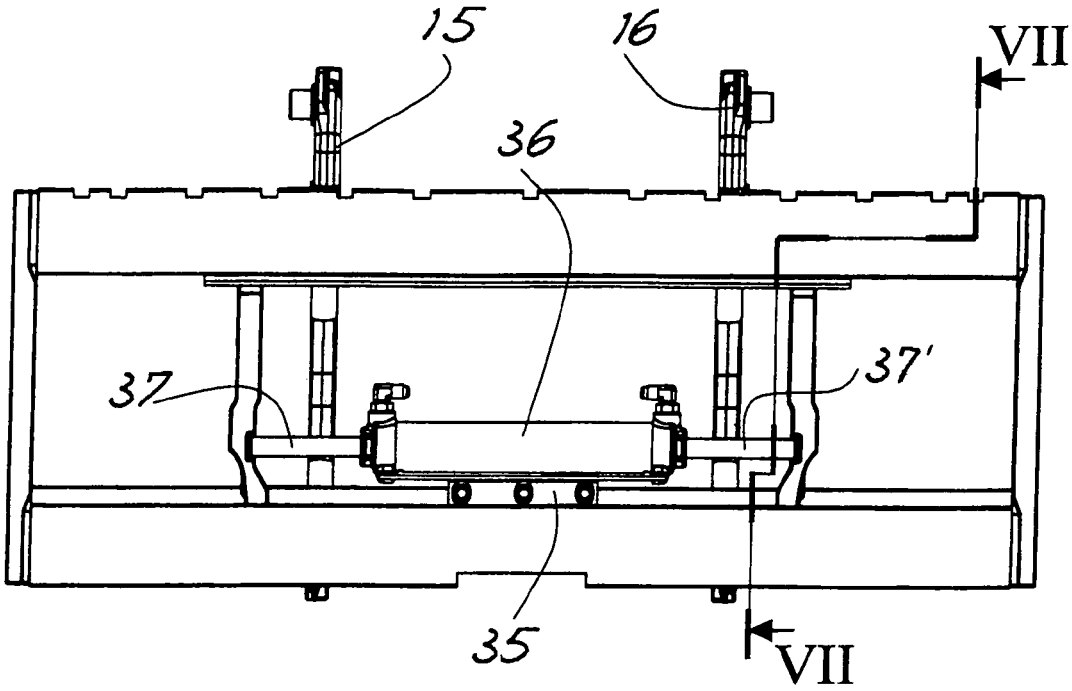
FIG. 8 is an elevation front view of the assembly in FIG. 7.

Shown in FIGS. 7 and 8 is a second arrangement of frames 10 and 25 in which the second frame slides on the first frame by means of two series of suitable upper and lower runners. In particular, the second frame comprises lower runners 38 of suitable low-friction material (nylon, for example) sliding on the surface 25 of the first frame and sliding runners 39 of a conformation adapted to define a U-shaped channel supported by the second frame for receiving the track 26 of the first frame. The U-shaped channel is internally coated with a suitable low-friction material (nylon, for example). In this manner, the lower runners support the vertical load whereas the upper runners avoid overturning and separation of the second frame.

Advantageously, the track surface 32 of the first arrangement and said U-shaped channel of the second arrangement can be made in such a manner that they can be dismantled from the second frame being replaceable with each other depending on requirements. Alternatively, they can be such disposed that they do not mutually interfere. Also the runners of a low-friction material can be made in the form of insertable or removable plugs. Thus the same frame 28, suitably equipped, can be used for all arrangements. A safety hook 40 is also present in the middle on the second frame, said hook being conveniently shaped for fitting with the right clearance for sliding, in the lower bar, just above the runner.

As clearly shown in FIG. 8, in the second arrangement actuator 36 is of a known hydraulic linear type with a double rod, fastened to the plate 35 of the first frame, in which the two opposite rods 37, 38 are connected to intermediate uprights of the second frame. In this way, when the first frame is dismantled from the second, the actuator keeps fastened to the second frame by means of said rods, while it is completely removed from the first frame.

Figure 9:
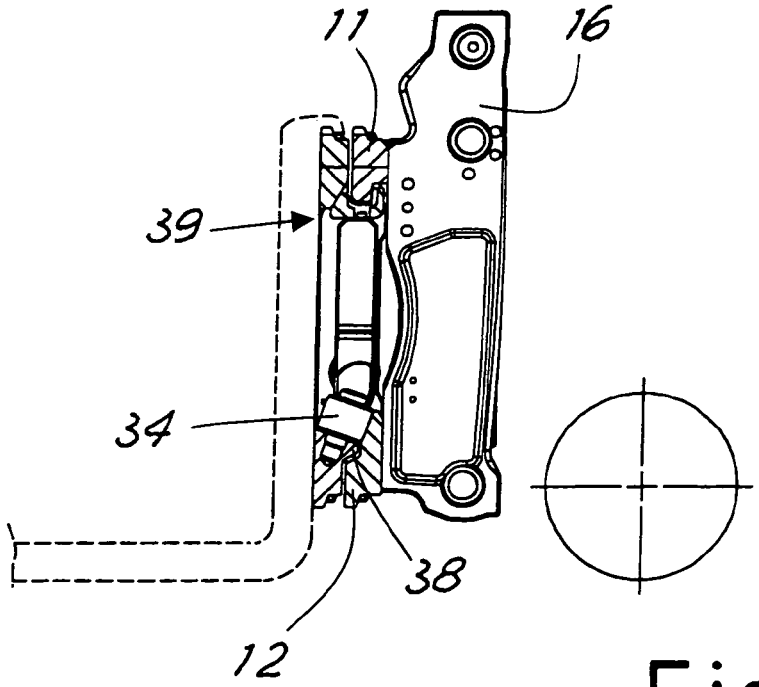
FIG. 9 is a sectional view, taken along line IX-IX in FIG. 10, of an assembly formed of the base element of FIG. 1 coupled with a third powered translating element and with mixed slide guides i.e. of the roller and runner type.
Figure 10:
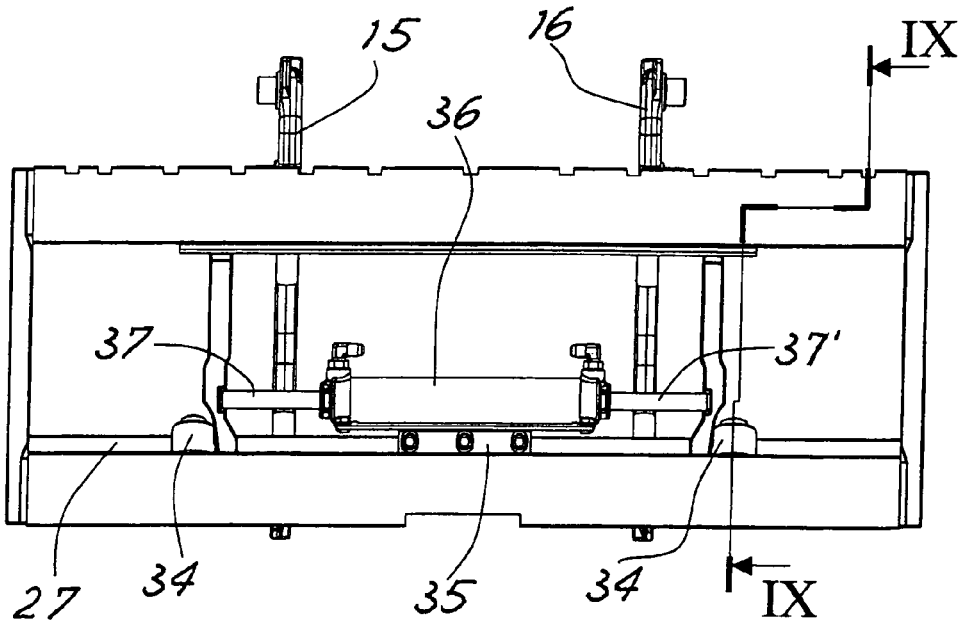
FIG. 10 is an elevation front view of the assembly in FIG. 9.
Figure 11:
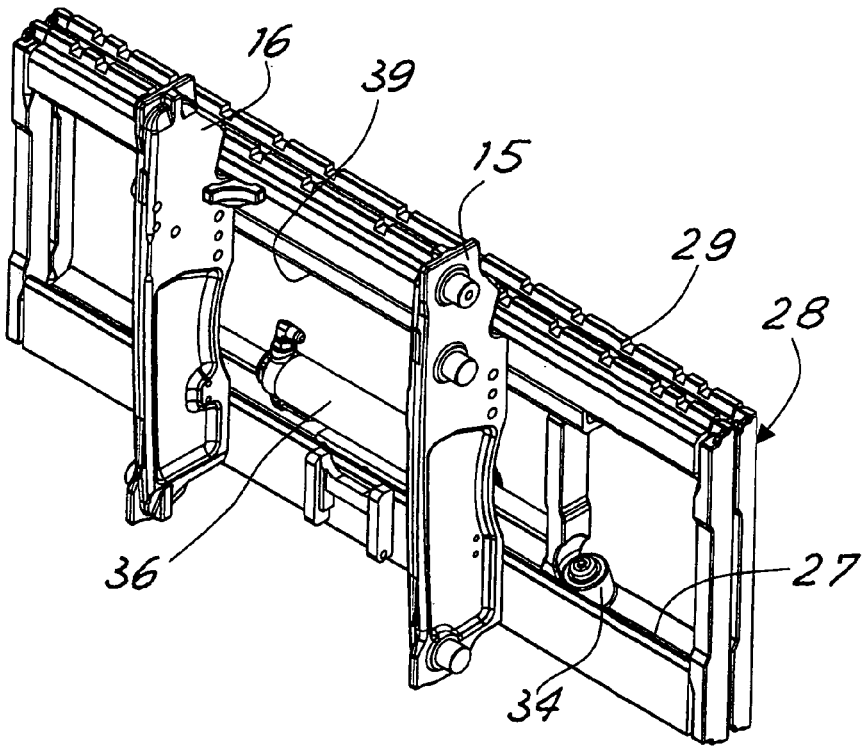
FIG. 11 is a rear perspective view of the assembly in FIG. 9.

Shown in FIGS. 9 to 11 is a third arrangement of the mixed type. In this arrangement the upper runners shown in the second arrangement and the lower rollers of the first arrangement are used. In this way, part of the load is supported by the rollers and frame overturning is avoided by the upper runners. Load support is also carried out by the lower runners 38. In this case too a safety hook can be provided.

At this point it is apparent that the intended purposes have been achieved by providing an assembly having a standardized fixed frame that forms the base frame for the different versions of integral translators and that, without other components of the translating assembly, becomes the fixed fork-carrying plate of the lift truck. Among the great number of advantages offered to truck manufacturers (and retailers), the following can be mentioned: possibility of mounting the standardized fixed frame indistinctly on all trucks and possibility of equipping this frame with only the suitable additional elements when it is necessary to have a truck with one of the contemplated versions of translating device. Thus production is simplified and the different orders for the different types of translators are eliminated; storage of semi-finished pieces and of the finished product is reduced; it is possible to mount the suitable translator on the multipurpose fork-carrying plate at the moment of sale, without uselessly mounting and dismantling parts.

Further advantages for a builder of integral translators are: being able to produce a standardized fixed frame for all translator models; being able to produce the fixed frame (that without components constitutes the fork-carrying plate of the truck) also for the builder of lift tracks and in an indistinct manner for all trucks produced by the latter; being able to simplify production by eliminating the different orders with the different types of fixed frames; being able to reduce storage of semi- finished pieces and of the finished product; being able to mount the suitable translator at the moment of finalizing the request from the customer; and being able to ensure much more reduced times for delivery of the translator.

Obviously, the above description of an embodiment applying the innovative principles of the present invention is given by way of non-limiting example of said innovative principles and therefore must not be considered as a limitation of the scope of the patent rights herein claimed.

What is claimed is:

1. A modular assembly for manufacturing structures for lateral translation and support of forks in lift trucks, comprising:

a first frame designed to be fastened to the lifting members of a lift truck and provided with upper hooking means for fastening of forks thereto;

a second frame designed to be slidably mounted on the first frame and provided with upper hooking means for fastening of forks thereto; and wherein the first frame and the second frame are provided with mounting means for laterally slidable and removable mounting of the second frame on the first frame to be laterally movable, upon command, on the first frame by means of an actuator, characterized in that the means for laterally slidable and removable mounting of the second frame on the first frame are separated from and independent of the upper hooking means for fastening of the forks to the first frame and are disposed below said upper hooking means for fastening of the forks to the first frame.

2. An assembly as claimed in claim 1. characterized in that the means for laterally slidable and removable mounting of the second frame on the first frame is comprised of rollers and/or runners sliding on shaped guides disposed between an upper horizontal bar and a lower horizontal bar of the frames.

3. An assembly as claimed, in claim 1, characterized in that for slidable mounting of the second frame on the first one, the first frame comprises:

a horizontal track surface in the vicinity of a lower side of the first frame and designed for sliding of corresponding first runners to be mounted or already mounted on the second frame;

a horizontal track on the first frame in the vicinity of an upper side of the first frame and designed for slidable fining of corresponding further runners to be mounted or already mounted on the second frame;

a second horizontal track surface at a position close to a lower side of the first frame and designed to receive a pair of rollers to be mounted or already mounted on the second frame.

4. An assembly as claimed in claim 1, characterized in that for fastening to the lifting members of a truck, the first frame comprises a pair of vertical plates projecting therefrom at the rear.

5. An assembly as claimed in claim 4, characterized in. that, for slidable mounting of the second frame on the first frame, the first frame comprises, on each of said plates of the pair, holes for fastening of a sliding roller Conning a slidable rest for a track surface present on the second frame.

6. An assembly as claimed in claim 5, characterized in that the means for laterally slidable and removable mounting of the second frame on the first frame is comprised of rollers and/or runners sliding on shaped guides disposed between an upper horizontal bar and a lower horizontal bar of the frames; and characterized in that each sliding roller is fastened to the respective plate of the first frame at a position close to an upper horizontal crosspiece of the first frame, and the suitable track surface formed on the second frame is supported by an upper horizontal crosspiece of the second frame.

7. An assembly as claimed in claim 5, characterized in that for slidable mounting of said second frame on the first frame, the second frame comprises at least one pair of sliding rollers mounted thereon and resting on a horizontal track surface formed on the first frame and in that the assembly simultaneously comprises two of said sliding rollers mounted on the first frame and two of said sliding rollers mounted on the second frame.

8. An assembly as claimed in claim 1, characterized in that the second frame, for slidable mounting of said second frame on the first frame, comprises at least one pair of sliding rollers mounted thereon and resting on a horizontal track surface formed on the first frame.

9. An assembly as claimed in claim 8, characterized in that the suitable track surface for support of the pair of rollers is formed on the first frame at a position close to a lower horizontal crosspiece of the first frame.

10. An assembly as claimed in claim 9, characterized in that for slidable mounting of the second frame on the first frame, a runner means is present which consists of a horizontal tack on the first frame, in the vicinity of an upper side thereof and on which corresponding sliding runners present on the second frame slidably fit and in that the assembly simultaneously comprises said runner means and the pair of rollers resting on the track surface close to the lower horizontal crosspiece of the first frame.

11. An assembly as claimed in claim 1, characterized in that for slidable mounting of the second frame on the first frame, a first runner means is present which consists of a first horizontal track surface on the first frame, in the vicinity of a lower side thereof and on which corresponding sliding runners present on the second frame rest.

12. An assembly as claimed in claim 11, characterized in that for slidable mounting of the second frame on the first frame, a second runner means is present which consists of a horizontal track on the first frame, in the vicinity of an upper side thereof and on which corresponding sliding runners present on the second frame slidably fit and in that the assembly simultaneously comprises the first and second runner means.

13. An assembly as claimed in claim 12, characterized in that said sliding runners of the second runner means have the conformation of a U-shaped channel and in that said track surface supported by an upper horizontal crosspiece of the second frame, and said U-shaped channel can be dismantled from the second frame and the track surface and U-shaped channel are replaceable with each other.

14. An assembly as claimed in claim 1, characterized in that for slidable mounting of the second frame on the first frame, a runner means is present which consists of a horizontal track on the first frame, in the vicinity of an upper side thereof and on which corresponding sliding runners present on the second frame slidably fit.

15. An assembly as claimed in claim 14, characterized in that said sliding runners of the said runner means have the conformation of a U-shaped channel.

16. An assembly as claimed in claim 1, characterized in that the first frame comprises a plate for mounting of said actuator, which is disposed at a centered position with respect to side edges of the first frame and in the vicinity of a lower edge of the first frame.

17. An assembly as claimed in claim 16, characterized in that the actuator is a double-rod hydraulic actuator and is hooked to the second frame by means of its opposite two rods.

18. An assembly as claimed in claim 1, characterized in that the actuator is an electric actuator.

19. An assembly as claimed in claim 1. characterized in that the hooking means for fastening of the forks to the first and second frames comprises a hooking step formed along an upper edge of the upper bar and along a lower edge of the lower bar of the frames, in compliance with UNI ISO 2328 specifications.

* * * * *